US009463948B2

(12) United States Patent
Bonanni et al.

(10) Patent No.: US 9,463,948 B2
(45) Date of Patent: Oct. 11, 2016

(54) CONTROL METHODS FOR PRODUCING PRECISION COILS

(71) Applicant: General Electric Company, Schenectady, NY (US)

(72) Inventors: Pierino Gianni Bonanni, Loudonville, NY (US); Derek Arthur Mangun, Scotia, NY (US); Leonardo Cesar Kammer, Niskayuna, NY (US); Hullas Sehgal, Guilderland, NY (US)

(73) Assignee: General Electric Company, Niskayuna, NY (US)

( * ) Notice: Subject to any disclaimer, the term of this patent is extended or adjusted under 35 U.S.C. 154(b) by 388 days.

(21) Appl. No.: 14/031,052

(22) Filed: Sep. 19, 2013

(65) Prior Publication Data

US 2015/0076275 A1 Mar. 19, 2015

(51) Int. Cl.
*B65H 54/64* (2006.01)
*B65H 54/28* (2006.01)

(52) U.S. Cl.
CPC ..... *B65H 54/2854* (2013.01); *H01F 41/064* (2016.01)

(58) Field of Classification Search
CPC .... B65H 52/2854; B21F 3/04; H01F 41/064
See application file for complete search history.

(56) References Cited

U.S. PATENT DOCUMENTS 4,741,500 A 5/1988 Lavanchy
4,746,075 A 5/1988 Hoxit
4,893,077 A * 1/1990 Auchterlonie ..... G01B 7/14 318/656
4,910,858 A 3/1990 Takeda et al.
4,951,889 A 8/1990 Camardella et al.
5,003,260 A * 3/1991 Auchterlonie ..... G01B 7/14 324/207.16
5,209,414 A 5/1993 Clemens et al.
5,332,987 A * 7/1994 Hennessy ..... H02N 15/00 310/90.5
5,699,977 A 12/1997 Watanabe
5,887,337 A 3/1999 Prochaska
6,341,744 B1 1/2002 Sugiuchi
7,459,904 B2 * 12/2008 Proksch ..... B82Y 35/00 324/207.18

FOREIGN PATENT DOCUMENTS

EP 0930626 A1 7/1999

OTHER PUBLICATIONS

C Darley, "Enhancement and Development of an Automated Fibre Optic Gyroscope Coil Winding Machine", Department of Mechanical Engineering, Massachusetts Institute of Technology, Issue Date: Feb. 11, 1998, 91 pages.

* cited by examiner

*Primary Examiner* — Emmanuel M Marcelo
(74) *Attorney, Agent, or Firm* — Melissa K. Dobson

(57) ABSTRACT

A method for sensing a position of a lead wire during winding of a wire on a coil form to form a precision coil is provided. The method includes acquiring data representative of at least a portion of the precision coil, identifying portions of the acquired data that represent the wire in the precision coil, and determining a position of the lead wire on the coil form from the identified portions of the acquired data.

32 Claims, 8 Drawing Sheets

CONTROL METHODS FOR PRODUCING PRECISION COILS

BACKGROUND

The invention relates to precision coils, and more particularly to precision control methods for producing precision coils.

High intensity, highly uniform magnetic fields are required for successful magnetic resonance imaging (MRI). The high intensity magnetic fields may be achieved using superconducting coils and cryogenic cooling. In some instances, to promote thermal and mechanical stability of such superconducting coils, it is desirable to support the wire within a layer of epoxy. The manufacture of these superconducting coils is subject to a high cost of superconducting wire and the relative difficulty of achieving consistency and uniformity in the distribution of the epoxy throughout the coil pack. Due to stringent electromagnetic requirements, and high thermal and mechanical stresses that pose a risk of magnet quench, it is desirable for these magnetic resonance (MR) coils to be free of defects such as gaps, ride-ups, drop-ins, and other anomalies. These cost and quality requirements constrain the manufacturing process to include precise control over the winding geometry, wherein it is desirable to form coils that consist of densely packed wire wound free of defects, while maintaining a precise layer by layer turn count.

Existing coil winding methods employ a winding machine in which the wire, maintained at constant tension, traverses linearly in a direction parallel to the axis of rotation of a spindle. In high precision applications involving small wire diameters and large coil diameters, absent the required degree of automatic control, operators may need to provide small-scale steering adjustments along with error detection and correction. However, manual correction is susceptible to human errors. Additionally, manual correction slows the process of coil winding.

Moreover, it may be noted that epoxy-supported coils are especially difficult to manufacture with precision. For example, the turns of a coil impregnated with epoxy may be difficult to place at the desired location, as the turns may slip from the desired location due to presence of the epoxy. Wet winding methods, in which the wire is coated with epoxy along the path to the winding bobbin, as opposed to being coated after winding, may be employed to maximize coverage of the epoxy. As will be appreciated, it is desirable to dispose the exact number of turns into the available space between the flanges of a winding bobbin and the correct nesting of wire between layers. Any substantial deviation of wire placement may accumulate during the winding process, and result in either insufficient space to place the desired number of turns, or extra space between turns, causing the next layer in the same location to ride up or drop in, respectively.

BRIEF DESCRIPTION

In one embodiment, a method for sensing a position of a lead wire during winding of a wire on a coil form to form a precision coil is provided. The method includes acquiring data representative of at least a portion of the precision coil, identifying portions of the acquired data that represent the wire in the precision coil, and determining a position of the lead wire on the coil form from the identified portions of the acquired data.

In another embodiment, a method for controlling a position of a lead wire on a coil form during winding of a wire on the coil form to form a precision coil is provided. The method includes acquiring data representative of at least a portion of the precision coil. Further, the method includes identifying portions corresponding to the wire in the precision coil from the acquired data. Also, the method includes determining a position of the lead wire on the coil form from the identified portions of the acquired data. Moreover, the method includes providing feedback control based on a difference between the determined position of the lead wire and a desired position of the lead wire.

In yet another embodiment, a method for feed-forward action is provided. The method includes providing a reference trajectory for a wire on a coil form. Further, the method includes determining a feed-forward trajectory for a linear stage. Furthermore, the method includes moving the linear stage according to the feed-forward trajectory such that the feed-forward trajectory enables the wire being disposed on the coil form to follow the reference trajectory.

In another embodiment, a control method for winding a wire on a surface of a coil form to produce a precision coil is provided. The method includes generating a feed-forward trajectory, determining a desired lead wire position, sensing a position of the lead wire, and providing feedback control based on a difference between the desired and sensed wire positions.

DRAWINGS

These and other features and aspects of embodiments of the invention will become better understood when the following detailed description is read with reference to the accompanying drawings in which like characters represent like parts throughout the drawings, wherein.

DETAILED DESCRIPTION

Figure 1:
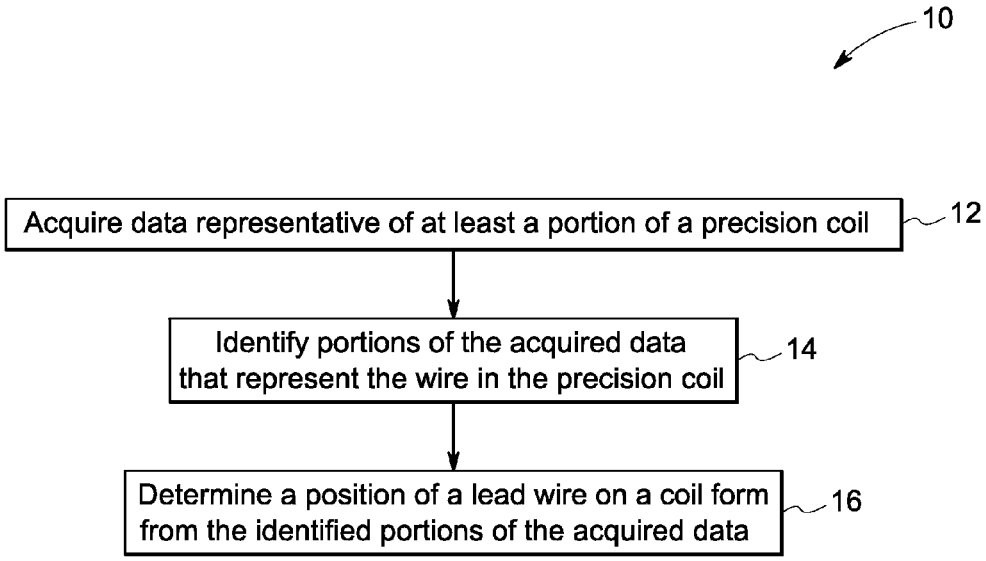
FIG. 1 is a block diagram of an example method for sensing a position of a lead wire during winding of a wire on a coil form to form a precision coil, in accordance with aspects of the present disclosure.

High intensity, uniform magnetic fields are desirable for performing effective magnetic resonance imaging (MRI). Typically, MRI employs superconducting electromagnetic coils. The superconducting electromagnetic coils may consist of densely packed wire. It is desirable to wind the superconducting electromagnetic coils with minimal or no defects while maintaining a precise layer by layer turn count. Non-limiting examples of defects in the superconducting electromagnetic coils may include gaps, crossings, ridges, or combinations thereof. It should be noted that superconducting electromagnetic coils with minimal or no defects may be referred to as precision coils. In certain embodiments, a winding geometry may be controlled to manufacture the superconducting precision coils that are configured to produce high intensity uniform magnetic fields. In some embodiments, at least a portion of a wire of a precision coil may be coated with a thermally conductive material to facilitate cryogenic cooling. In some embodiments, the wire may be coated with an epoxy resin.

In some embodiments, the process of winding the superconducting precision coils having a resin coating may be controlled using automated or semi-automated control methods or control method architectures. As used herein, the terms "control method" or "control method architecture" may be used interchangeably throughout the application. In some embodiments, the control methods may reduce variations in the precision coils. Further, the control methods may facilitate reduction of defects in the precision coils. Accordingly, the control methods may facilitate reduction in the number of rejected coils. In certain embodiments, the control methods may be configured to produce precision coils in a time efficient manner and with lower labor and processing costs. Moreover, in certain embodiments, the control methods may employ techniques to dispose a desirable number of wire turns into an available space while providing a desirable nesting of wire between adjacent layers of wire.

In some embodiments, the methods may be based on closed-loop automatic control, closed-loop digital feedback, or both. Also, in some embodiments, the control methods may optionally sense a position of a lead wire. As used herein, the term "lead wire" refers to a portion of the wire that is about to be in physical contact with the coil form at a given instant in time. Accordingly, the portion of the wire indicated as the lead wire at a given instant in time may change as the winding progresses.

Advantageously, the closed-loop control based methods may make provisions for guiding the wire placement and correcting wire placements in instances of errors. In one example, the control methods may include detecting an anomaly in a position of the wire while winding the wire. In one example, the anomaly detection may be performed using profilometry (e.g., laser profilometry). In some embodiments, anomaly detection for the coil may be performed in real time without interruption to the normal winding pace. Further, the methods may facilitate reduced winding defects while providing a time efficient winding process. In one example, the closed-loop control based methods may require relatively lesser time when compared to methods that require manual identification or determination of defects. In certain embodiments, the control methods may be performed with minimal operator intervention.

The contents of U.S. patent application entitled "SYSTEMS FOR PRODUCING PRECISION MAGNETIC COIL WINDINGS," concurrently filed and having assigned Ser. No. 14/031,053 are hereby incorporated by reference in its entirety.

In certain embodiments, a geometric model of the winding geometry may be used to generate a reference trajectory for tracking the winding operation of the precision coils. In some embodiments, during the winding process, an actual position (also referred to as the "sensed position") of the wire and a desired position of the wire may be compared to determine whether the wire is positioned suitably. By way of example, a position of a portion of the wire immediately after disposing the wire on a surface for forming the precision coil is compared to a corresponding point in the reference trajectory to provide a feedback to the control method regarding positioning of the wire. Also, in some embodiments, a wire position may be sensed, and subsequently, the feedback on the wire position may be used to control the wire supply from a linear stage to a bobbin. It should be noted that the terms "bobbin," "coil form," and "support" may be used interchangeably throughout the application. In one example, the wire position may be sensed using direct measurement, or sensing through estimation, or simply sensing through human observation. In a non-limiting example, the wire position may be sensed using a profilometer, such as, but not limited to, a laser profilometer. In one example, computer algorithms may be employed to sense the wire position through estimation. Moreover, in an example where the wire position is sensed via human observation, the observation may be made on a displayed coil profile.

Furthermore, in certain embodiments, instead of merely moving the wire directly in accordance to a given reference trajectory, feed-forward trajectory generation may be used to facilitate disposing wire turns in desirable positions on a coil form, such as, but not limited to, a bobbin. Additionally, in certain embodiments, the wire may be disposed using a feed-forward mechanism, which in the absence of disturbance effects, may be used to facilitate a much narrower transition region in one or more wire turns in the precision coils. The feed-forward mechanism may facilitate the narrower transition region by compensating for response of the wire at a point of contact of a bobbin surface to a trajectory of the dispensing mechanism. In one embodiment, the feed-forward action may be applied using a kinematic and dynamic model of the winding process. In one example, an actuator may be used to design a suitable action for feed-forward.

FIG. 1 illustrates a flow chart 10 of an example method for sensing a position of a lead wire. The position of the lead wire may be sensed during winding of a wire on a coil form to form a precision coil. In one example, the position of the wire may be sensed in real time. As indicated by block 12, the method includes acquiring data representative of at least a portion of the precision coil.

In one embodiment, the method may include determining a profile of the coil from the acquired data. In one example, laser profilometry may be used to acquire data representative of the portion of the precision coil. The data acquired with laser profilometry may be used to determine the profile of the coil. Also, in one example, the acquired data may be stored. In another example, the acquired data may not be stored. Furthermore, in some embodiments, the acquired data may be representative of a profile of the portion of the precision coil. However, in some other embodiments, the acquired data may be representative of a portion of the lead wire. In one embodiment, the method may include sensing the position of the lead wire from the acquired data using a computer processing algorithm.

Additionally, in certain embodiments, the process winding of the wire on the coil form may be monitored in real time. The monitoring may be performed using the acquired data representative of the portion of the precision coil. In certain other embodiments, a quality of the precision coil may be assessed at a later time using the stored data.

In some embodiments, a direct measurement method may be used to acquire data representative of the portion of the precision coil. A non-limiting example of the direct measurement method may include imaging at least a portion of the winding process, and acquiring the imaging data of the portion of the winding process. In one example, the method includes visually identifying the position of the lead wire in the imaging data. In another example, the method uses a computer image processing algorithm to estimate the position of the lead wire from the imaging data.

Furthermore, as depicted by block 14, the method includes identifying portions of the acquired data that represent the wire in the precision coil. By way of example, in case of wet winding techniques, the method may include identifying or differentiating between epoxy and wire in the acquired data.

The method may also include determining a position of the lead wire on the coil form from the identified portions of the acquired data, as indicated by block 16. In one embodiment, determining the position of the lead wire includes determining a longitudinal coordinate, or a radial coordinate, or both the longitudinal coordinate and radial coordinate of the lead wire on the coil form.

As used herein the term "radial" refers to a direction outward from an axis of rotation of the coil form. Further, as used herein, the term "longitudinal" refers to a direction parallel to an axis of rotation of the coil form.

In some embodiments, determining the position of the lead wire on the coil form from the identified portions of the acquired data includes determining a position of the wire at a point of tangency of the wire on the coil form. In one embodiment, a profilometer (e.g., a laser profilometer) may be positioned at the point of tangency of the lead wire. In this embodiment, the position of the lead wire at the point of tangency is determined by identifying the lead wire, and estimating a geometric center of the lead wire. However, in some other embodiments, determining the position of the lead wire includes determining a position of the wire in the immediate neighborhood of the point of tangency of the wire on the coil form.

Figure 2:
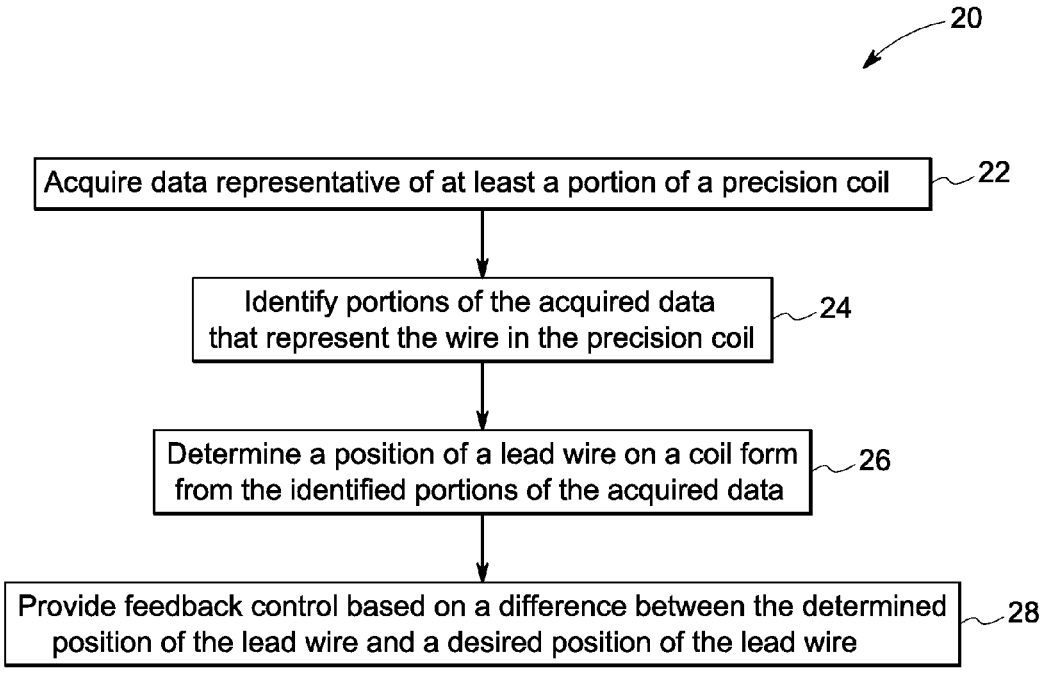
FIG. 2 is a block diagram of an example method for controlling a position of a lead wire on a coil form during winding of a wire on a coil form to form a precision coil, in accordance with aspects of the present disclosure.

FIG. 2 illustrates a flow chart 20 of an example method for controlling a position of a lead wire on a coil form during winding of a wire on the coil form to form a precision coil. As indicated by block 22, data representative of at least a portion of the precision coil is acquired. Furthermore, as depicted by block 24, portions of the acquired data corresponding to the wire in the precision coil are identified. Moreover, at block 26, a position of the lead wire on the coil form is determined from the identified portions of the acquired data.

In some embodiments, determining the position of the lead wire on the coil form from the identified portions of the acquired data includes determining a position of the wire at a point of tangency of the lead wire on the coil form. In one embodiment, determining the position of the lead wire on the coil form from the identified portions of the acquired data may include using a direct measurement method. In another embodiment, determining the position of the lead wire on the coil form from the identified portions of the acquired data may include using a computer algorithm. By way of example, the computer algorithm may be applied on a profile of the portion of the precision coil to determine the position of the lead wire on the coil form.

In certain embodiments, determining the position of the lead wire includes displaying a profile of the coil, superimposing on the display of the coil profile a scale representative of coordinates for the coil form or a reference line marking the desired position of the lead wire, or both, and identifying the position of the lead wire by recognizing the pattern of the lead wire against the superimposed scale or reference line.

At block 28, a feedback control is provided based on a difference between the determined position of the lead wire and a desired position of the lead wire. In some embodiments, providing the feedback control based on the determined position of the lead wire includes comparing the determined position of the lead wire to the desired position of the lead wire, and if required, providing a correction to a position of a wire disposing device to correct the position of the lead wire. The position of the wire disposing device may be corrected automatically or manually.

Figure 3:
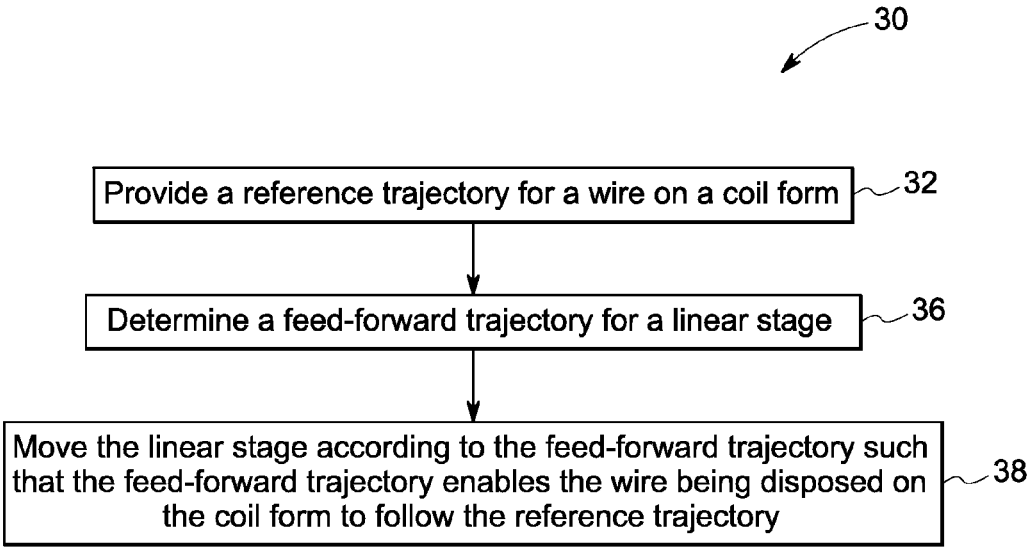
FIG. 3 is a block diagram of an example method for feed-forward action, in accordance with aspects of the present disclosure.

FIG. 3 illustrates a flow chart 30 representative of an example method for a feed-forward action. As indicated by block 32, the method begins by providing a reference trajectory for a wire on a coil form. At block 34, a stage trajectory is determined for a linear stage using the reference trajectory for the wire. Furthermore, at block 36, a feed-forward trajectory for the linear stage is determined. In one embodiment, the feed-forward trajectory of the linear stage is calculated based on a maximum speed of the linear stage, a maximum acceleration of the linear stage, the reference trajectory of the wire, or combinations thereof. In another embodiment, the feed-forward trajectory is determined using a kinematic or dynamic model of a winding process.

In addition, at block 38, the linear stage is moved according to the feed-forward trajectory such that the feed-forward trajectory enables the wire being disposed on the coil form to follow the reference trajectory.

Figure 4:
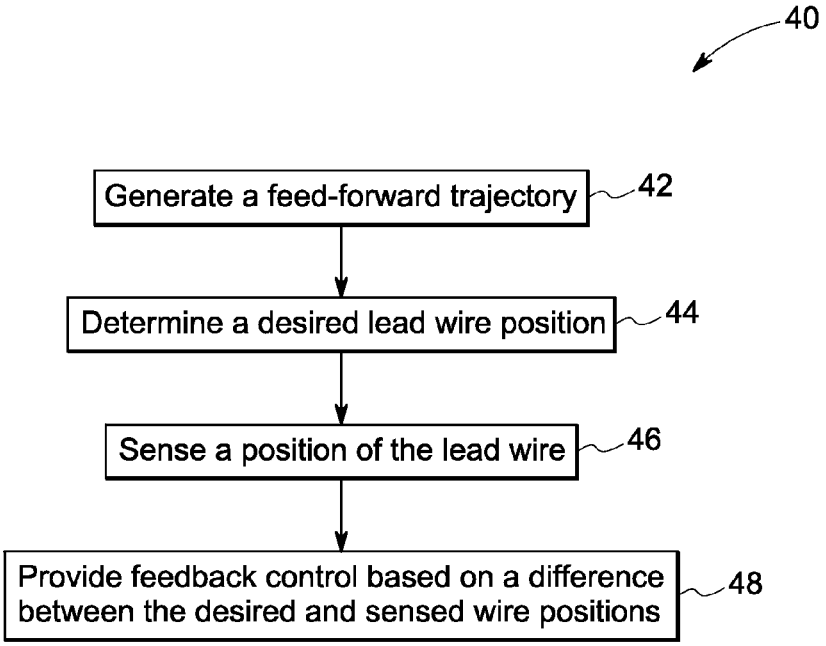
FIG. 4 is a block diagram of an example control method for winding a wire on a surface of a coil form to produce a precision coil, in accordance with aspects of the present disclosure.

FIG. 4 illustrates a flow chart 40 for an example control method for winding a wire on a surface of a coil form to produce a precision coil. At block 42, a feed-forward trajectory is generated. In some embodiments, the feed-forward trajectory may be generated for a linear stage. The feed-forward trajectory may be generated using a reference trajectory for the lead wire. In one embodiment, generating the feed-forward trajectory includes determining a transfer function between a position of the linear stage and a resultant position of the lead wire, and calculating a trajectory for the linear stage based on the transfer function and a reference trajectory for the lead wire.

In certain embodiments, the feed-forward trajectory may be configured to compensate for behavior predicted by kinematic and dynamic models of a winding process. In some embodiments, the feed-forward trajectory may be configured to adjust one or more of a position, a speed, an acceleration, or combinations thereof, of the linear stage to compensate for the kinematic and dynamic response of the winding process. In one embodiment, providing the feed-forward trajectory minimizes a transition region between two consecutive turns of the precision coil.

At block 44, a desired lead wire position is determined. By way of example, the desired position of the lead wire at a given instant in time may be determined using the reference trajectory. Furthermore, at block 46, a position of the lead wire is sensed. In one embodiment, a sensed position of the lead wire is used by the feedback control for actuating the linear stage. In some embodiments, sensing the position of the lead wire may include using a matched filter-based algorithm to estimate a position of the lead wire from a profile of the portion of the coil. In one embodiment, sensing the position of the lead wire may include directly measuring the position of the lead wire.

At block 48, a feedback control based on a difference between the desired and sensed wire positions is provided. The feedback control may be provided to a controller unit. The controller unit may be coupled to the linear stage. The linear stage may be moved based on the feedback received by the controller unit.

In one embodiment, the wire is disposed in the form of a plurality of loops, where each loop includes a circular portion and a transition region, where a plane of the circular portion of the loop is parallel to a cross-sectional plane of the coil form. In certain embodiments, the feedback control may be a closed-loop control. In one embodiment, the closed-loop control may be provided in an intermittent fashion. In this embodiment, the closed-loop control may be employed during a portion of the winding turn, and open-loop control may be employed in the remaining portion. For example, control may revert to open-loop control, at cross-over transitions.

Furthermore, in certain embodiments, the feedback control function of the control algorithm may be switched on and off completely or partially; that is, the offset accumulated by an integral action may be maintained to correct the misalignment between the center of the linear stage and the center of the profilometer. The misalignment between the center of the linear stage and the center of the profilometer may be corrected at all cross-over transitions, given that the feed-forward action introduces a significant variation in a set-point of the wire position. Also, in some instances, the control action may be automatically switched off at the completion of the first layer to benefit from the natural tendency of the wire to nest in the valleys of the underlying layer's turns, which may alone provide sufficient control action, provided that the underlying layer is correctly wound.

In some embodiments, the feedback control may be provided manually. For example, the feedback control may be provided by a human operator. In some other embodiments, the feedback control may be provided automatically. For example, the feedback control may be provided using a computer or a controller unit. In one embodiment, the feedback control may be provided as a combination of manual and automatic control. Furthermore, in one example, the position of the lead wire on the coil form may be adjusted based on the feedback control. In some embodiments, the feedback control is configured to reduce variations in the position of the lead wire. In one example embodiment, the feedback control is used for disturbance rejection. By way of example, the feedback control is used to compensate for un-modeled or unexpected changes generated by process disturbances, material variations, or both.

Figure 5:
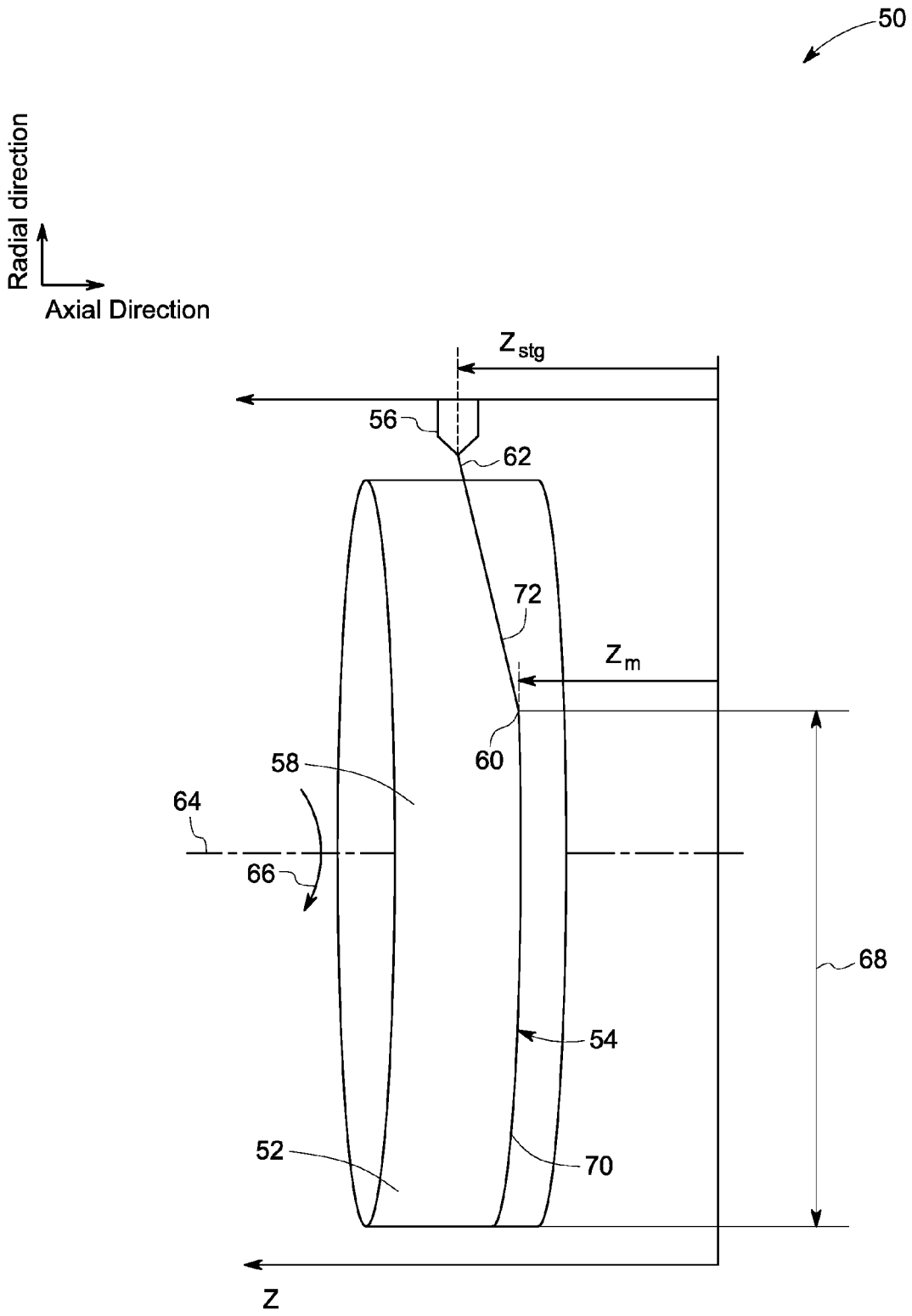
FIG. 5 is a schematic representation of a portion of a winding machine, in accordance with aspects of the present disclosure.

Referring now to FIG. 5, a schematic representation of a portion of a winding machine 50 is illustrated. The winding machine 50 may include a coil form, such as, but not limited to, a bobbin 52. A wire 54 to be disposed on the bobbin 52 may be fed using a wire disposing device (not shown). The wire disposing device is a device that is used to dispose the wire at a desirable location on the bobbin 52. The wire disposing device may be a part of a linear stage (not shown), where the linear stage is configured to move in a translational motion to cover the width or axial direction of the bobbin 52. Reference numeral 56 illustrates a head of the wire disposing device. $Z_{stg}$ represents a position of the head 56 of the wire disposing device, where the position of the head is representative of a position of the stage that includes the wire disposing device. The head 56 of the wire disposing device may be maintained at a constant distance from a surface 58 of the bobbin 52. The distance between the bobbin 52 and the head 56 of the wire disposing device may be calculated as a standoff distance between a tip of the head 56 that is closest to the bobbin 52, and a point of contact of the wire 54 on the bobbin 52. The point of contact of the wire 54 on the bobbin 52 may be generally represented by reference numeral 60. The portion of the wire 54 represented by reference numeral 62 is the unwound wire at that given point in time. In the illustrated embodiment, at any given point of time, the portion 62 may be dispensed by the wire disposing device, but is yet to be disposed on the bobbin 52 at a given point in time. As the bobbin rotates with time, the portion 62 of the wire 54 is subsequently disposed on the surface 58 of the bobbin 52. An axis of rotation of the bobbin is generally represented by reference numeral 64, and the direction of rotation is represented by the arrow 66.

Reference numeral 68 represents a portion of the wire 54 that is disposed on the bobbin 52. The wire 54 may be provided to the bobbin 52 at an angle with respect to a portion 70 of the wire 54 that is already disposed (wound) on the bobbin 52. The angle at the point of contact 60 of the wire 54 may be represented generally by reference numeral 72. $Z_m$ represents a position on the bobbin 52, where the wire 54 makes physical contact with the bobbin. In one embodiment, the angle 72 results in movement of the wire 62 along the axial direction. The amount of axial movement of the wire in a given time may be related to a tangent of angle 72, and the circumferential distance traversed by the wire in the given time. In one embodiment, the circumferential distance traversed by the wire may be a product of an amount of rotation and radius of the wire point of contact to the bobbin or mold from the rotational axis.

In certain embodiments, the wire winding process may be represented by one or more models or algorithms. In some of these embodiments, the winding model may be based on one or more assumptions, such as, but not limited to: (a) the wire is straight and uniform; (b) upon contact with the bobbin, the wire is not subject to disturbances and does not slip substantially in an axial direction; and (c) curvature of the wire at the point of contact is neglected.

Moreover, in some embodiments, as the bobbin 52 turns, the wire position at the point of contact to the bobbin, $Z_m$ may be modeled to approach the linear stage position, $Z_{stg}$, along a path described by the unwound wire orientation. The change in the position of the wire may be represented by a product of a slope of the unwound wire with respect to the radial coordinate of the wire and a length of the wire wound on the bobbin. Eq. (1) represents an example of such a dynamic model.

$$Z_m(t) = Z_{m0} + \pi D \frac{Z_{stg}(t) - Z_m(t)}{\text{standoff}} q(t) \qquad \text{Eq. (1)}$$

where $Z_{m0}$ represents an initial condition for the position of the wire at the point of contact, D is representative of twice the radial distance of the wire point of contact to the bobbin from the rotational axis, standoff is the standoff distance between the wire disposing mechanism and the wire point of contact to the bobbin, and q is the fractional turn count for the current turn. In one embodiment, a discrete-time approximation for the model represented by Eq. (1) may be based on an assumption that the discretization is fine enough for the slope of the unwound wire to be constant during each time step. The resulting first-order approximation for the wire dynamics model is represented by Eq. (2).

$$Z_m(n) = Z_m(n-1) + \pi D \frac{Z_{stg}(n) - Z_m(n)}{\text{standoff}}(q(n) - q(n-1)) \quad \text{Eq. (2)}$$

where, the variable n represents the index for the value of the current sample; and n−1 represents the index for the value of the preceding sample.

In certain embodiments, when forming the MRI coils, it is desirable to maintain a constant tension in the wire traversing from the wire supply or supply source to the bobbin to facilitate smooth and even coiling. Further, a change in the tension in the wire may result in irregularities in the precision winding coil. In certain embodiments, passive or active tension control devices may be used to control the tension at a desirable value. Also, in one embodiment, the speed of rotation of a spindle of the bobbin may be controlled by a drive unit. Moreover, in some embodiments, the drive unit may include encoders to monitor a shaft speed. A value for a desirable speed of rotation of the bobbin may be provided by a computer or an operator. In embodiments where the speed of rotation of the bobbin is provided by the operator, the speed may be provided by actuating a pedal that is operatively coupled to the bobbin.

In certain embodiments, the feedback control may be used to adjust the position of the wire to maintain a desirable pitch between consecutive turns. Additionally, in certain embodiments, a control algorithm may be used to obtain desirable values of a wire packing density, layer uniformity, and a desirable length of one or more transition regions. Advantageously, in some embodiments, the control algorithm may be configured to take into account the dynamics associated with manipulation of the wire, or operate within the limitations of the winding system hardware, or both, and may not be constrained to any particular system implementation. In certain embodiments, a modular approach may be selected to minimize or eliminate the dependence of the method on any particular system. Non-limiting examples of components in a modular approach may include trajectory generation for the wire to be wound on the bobbin, wire dynamics estimation, lead-wire estimation, and feedback control action including generalized algorithms adaptable to multiple platforms.

Figure 6:
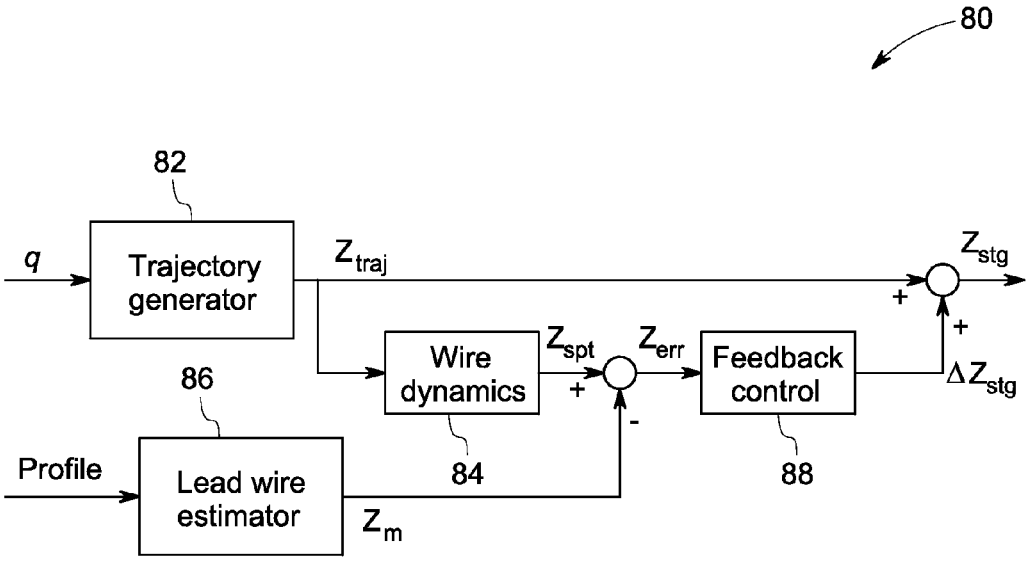
FIG. 6 is a block diagram of an example control method architecture for an automated winding process, in accordance with aspects of the present disclosure.

FIG. 6 illustrates a simplified block diagram 80 of example control method architecture for an automated winding process. In the illustrated embodiment, the control method architecture may include an example closed-loop control model for winding precision windings. The feedback control algorithm may be generally represented by the block diagram 80.

In one embodiment, the closed-loop control may include closing the loop on a lead-wire position. In particular, feedback data may be representative of the wire position. Alternatively, in another embodiment, the closed-loop control may include closing the loop on the position of the stage. In particular, in this embodiment, the feedback data may be representative of the position of the linear stage. Moreover, in one embodiment, the closed-loop control may use automatic controls, such as but not limited to a computer, a controller, or both to operate. In an alternative embodiment, the closed-loop control may use a human operator to operate the system.

At the trajectory generation block 82, an input (q) representative of turn counts of the bobbin at a given time, may be provided. The value of q may be a real number reflecting the total number of whole and partial turns of the bobbin.

An output of the block 82 is represented by "$Z_{traj}$". In some embodiments, $Z_{traj}$ may represent the desired position of the stage in an axial direction of the coil. For a particular turn, the $Z_{traj}$ may have a determined value. For every value of q, there is a corresponding value of $Z_{traj}$.

In certain embodiments, there may exist a one-to-one relationship between the wire disposing device and the position of the wire on the bobbin, while in certain other embodiments, the relationship between the wire disposing device and the position of the wire on the bobbin may not be one-to-one. To estimate a transfer function between the position of a stage that houses the wire disposing device and the desired position of the wire, a model of a wire dynamic response may be provided. The wire dynamics model may be represented by block 84. The block 84 may correspond to the winding models represented in Eq. (2) and Eq. (6). An input to the block 84 is $Z_{traj}$. Also, an output of the wire dynamics block 84 is represented by "$Z_{spt}$" and is representative of a desired trajectory of the wire.

An input representative of a measured coil profile denoted by the letter "p" is fed to block 86 representative of a lead wire estimator. The measured profile p is used by the lead wire estimator to calculate $Z_m$, where $Z_m$ represents an instantaneous axial position of the lead wire. $Z_m$ and $Z_{spt}$ are used to calculate an error ($Z_{err}$) in the actual lead wire position as compared to the desired lead wire position.

The value of $Z_{err}$ may be used to calculate feedback control action and command a change in the position of the stage, as illustrated by block 88 representative of a feedback control. The change in position of the stage, represented by $\Delta Z_{stg}$, may be an output of the block 88. This output, $\Delta Z_{stg}$, may be provided as the feedback actuation.

In certain embodiments, the feedback control 88 may be used to reduce low-frequency variations in the wire position. By way of example, the feedback control 88 may be configured to reduce offset in the system that may be caused by a misalignment between the center of the stage and the center of the profilometer. In one embodiment, the control algorithm may include integral action on the error, $Z_{err}$, where $Z_{err}$ is the difference between the desirable wire position, $Z_{spt}$, and the actual wire position, $Z_m$.

In certain embodiments, the model represented by Eq. (2) may be validated through experimentation. The validated model may be incorporated into the trajectory generator formulation as well as the closed-loop control system in two areas: filtering the stage trajectory to obtain the wire set point, that is the desired wire position for tracking-error calculation, and for setting the tuning parameters to achieve stable operation, for example, via model-based controls design.

In one embodiment, a desired trajectory may target a reduced transition length. In certain embodiments, the transition-reduction algorithm may be used to compute a stage trajectory that rides on the motion limits of the stage and provides a specified cross-over pitch within a minimum time. It should be noted that the stage dynamics may be faster in contrast with the wire dynamics. It should be noted that in some embodiments, the trajectory generation may include the feed-forward action, whereas, in some other embodiments, the trajectory generation may not include the feed-forward action. In one embodiment, the computation of the feed-forward action may use only the stage acceleration limit. Consideration of the stage motion limits can also facilitate specification of maximum winding speed or minimum transition time.

Figure 7:
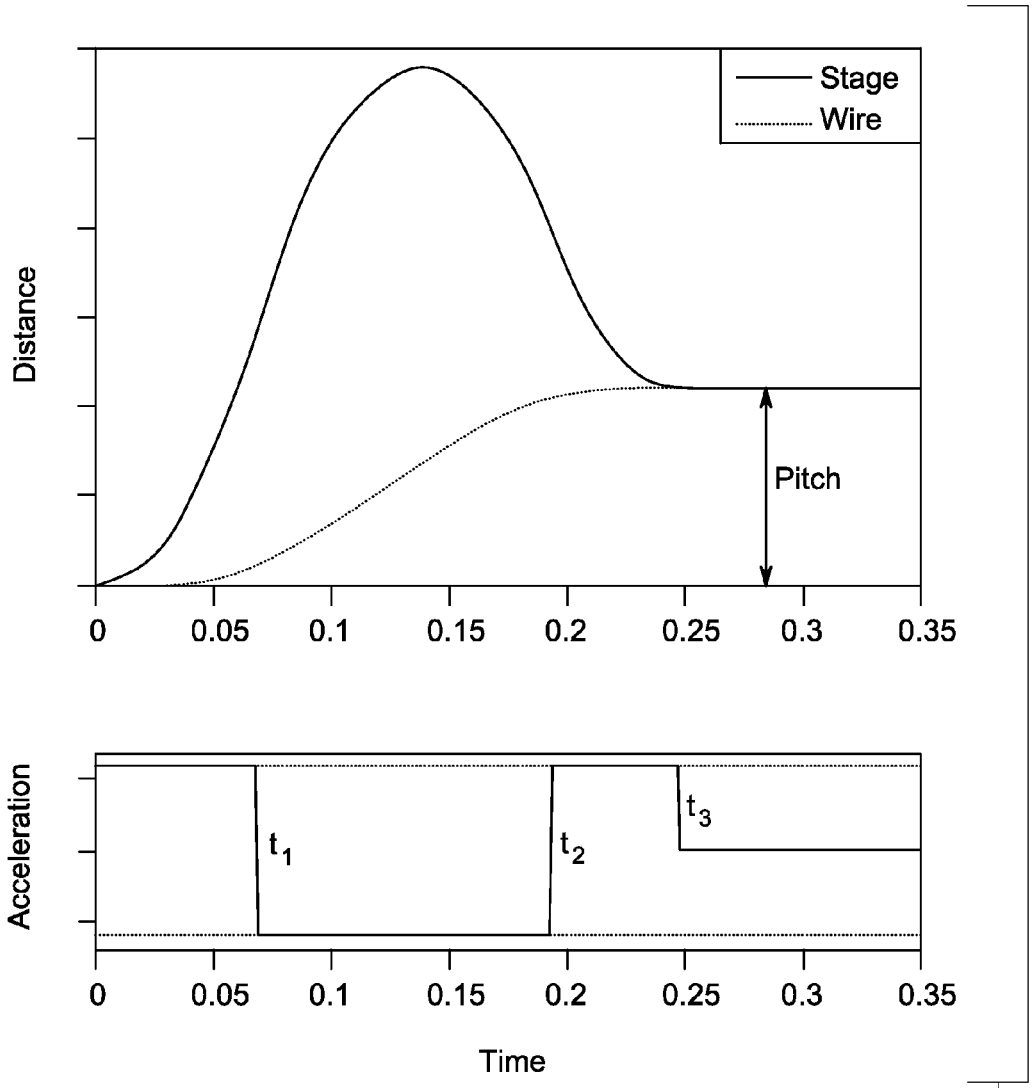
FIG. 7 is a graphical representation of an example of a wire transition and associated stage motion, in accordance with aspects of the present disclosure.

FIG. 7 illustrates an example of a wire transition as well as the stage motion that achieves that purpose in the minimum time. As illustrated, the stage acceleration may be at its limit, either positive or negative. As illustrated in Eqs. (3) and (4), the second and third switching times, $t_2$ and $t_3$, may be calculated as a function of the first switching time, $t_1$, the desired pitch, and the maximum acceleration, $a_{max}$:

$$t_3 = 2t_1 + 2\sqrt{t_1^2 + \frac{\text{pitch}}{a_{\max}}} \quad \text{Eq. (3)}$$

$$t_2 = t_1 + 0.5t_3 \quad \text{Eq. (4)}$$

In certain embodiments, Eqs. (3) and (4) may be used to ensure that the stage returns to zero speed at exactly one pitch distance from the starting position at time $t_3$. It is desirable to determine a value of $t_1$ such that the wire position also reaches the same end position at time $t_3$. In one embodiment, the value of $t_1$ may be iterated to determine a desirable solution, or to approximate $t_1$ as a function of the system parameters in the neighborhood of the current settings.

In one example, for specific system settings, Eq. (5) represents an empirical equation as an approximation of $t_1$.

$$t_1 = \max\left(-0.0056 + 0.0504\tau^{0.516} + 0.899t_{sqr}^{0.48} + 0.802\tau^{0.963}t_{sqr}^{0.596}, \sqrt{t_{sqr}}\right) \quad \text{Eq. (5)}$$

where, $$\tau = \frac{60\ \text{standoff}}{\pi D\omega_{max}},$$

$$t_{sqr} = \frac{\text{pitch}}{a_{\max}}$$

Subsequent to determining the switching times, the position of the linear stage may be determined as a function of time and the system settings. Non-limiting examples of the system settings may include bobbin diameter, speed of rotation of the shaft, diameter of the wire being wound, tension in the wire, standoff distance, maximum stage acceleration, or maximum stage velocity.

Figure 8:
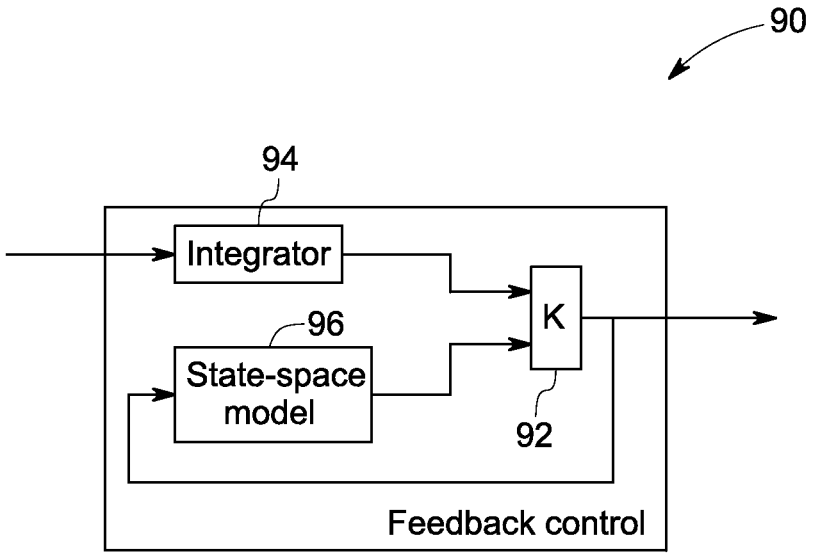
FIG. 8 is a block diagram of an example feedback control mechanism, in accordance with aspects of the present disclosure.

FIG. 8 illustrates a block diagram of a feedback control mechanism 90 for an example control algorithm. In the illustrated embodiment, a matrix K, generally represented by reference numeral 92, is representative of static state feedback gains that are used to position one or more closed-loop poles at desired locations in the system. The states of the process may be reconstructed, in open-loop, from the desired stage correction term. An integral action of an integrator 94 augments the state vector 92 for the final state feedback. In one embodiment, the control law of FIG. 8 may be presented as a dynamic-inversion controller. However, a state-space model representation 96 provides an easier way to provide anti-windup on the integral action. Alternatively, one may consider utilizing simple PI or PID feedback controllers.

In certain embodiments for the closed-loop control, the discrete-time nature of the winding setup may be taken into account. For example, the simple first-order wire dynamics may be converted into its discrete-time representation, as shown in Eq. (2). Further, it may be required to add sample delays in the closed-loop control algorithm to account for the stage response as well as the processing of the lead wire estimation. In some embodiments, the wire dynamics may depend on the rotational speed of the bobbin. In some of these embodiments, a control action may be computed based on a fixed change in the bobbin turn count, e.g. $\Delta q=0.01$, as opposed to a fixed sampling rate. In one embodiment, the model of the wire dynamics given in Eq. (2) may be represented for control design and implementation purposes by Eq. (6) as:

$$Z_m(z) = \frac{b}{z^2 + az} Z_{stg}(z) \quad \text{Eq. (6)}$$

where z is the forward shift operator, i.e., $zX(q)=X(q+\Delta q)$, $Z_m$ is the measured position of the lead wire, $Z_{stg}$ is the commanded stage position, $$b = \frac{\pi \Delta q D}{\text{standoff}},$$

and $a=(b-1)$.

In one embodiment, the control algorithm may be implemented digitally. In this embodiment, the operator may input the geometry associated with winder setup and desired precision coil, the maximum winding speed and actuator limits, and aggressiveness for control action. At each $\Delta q=0.01$, the algorithm determines whether the closed-loop control is activated and may accordingly calculate the control action and change in $Z_{spt}$ to be added to the nominal value.

It should be noted that the success of the closed-loop operation relies at least partially on the determination of the position of the lead wire. In one embodiment, raw data representative of a profile of the coil (e.g., data obtained from the profilometer) may be processed using a matched filter-based algorithm to determine the position of the lead wire, which is fed to the controller to produce the necessary actuation of the stage. Furthermore, in some embodiments, the method enables detection of the "true" wire centers while rejecting features due to excess epoxy build up, which may appear with a similar semicircular profile but the wrong diameter. To this effect, in some of these embodiments, the lead wire finding algorithm may be refined by applying one or more heuristic rules. By way of example, one such rule may require sufficient continuity from previous profiles, and thus would stipulate a limited search region for the lead wire solution as measured from the previous solution. In another example, a search region limiting the solution to a small neighborhood of the desired or commanded wire position may be employed.

Figure 9:
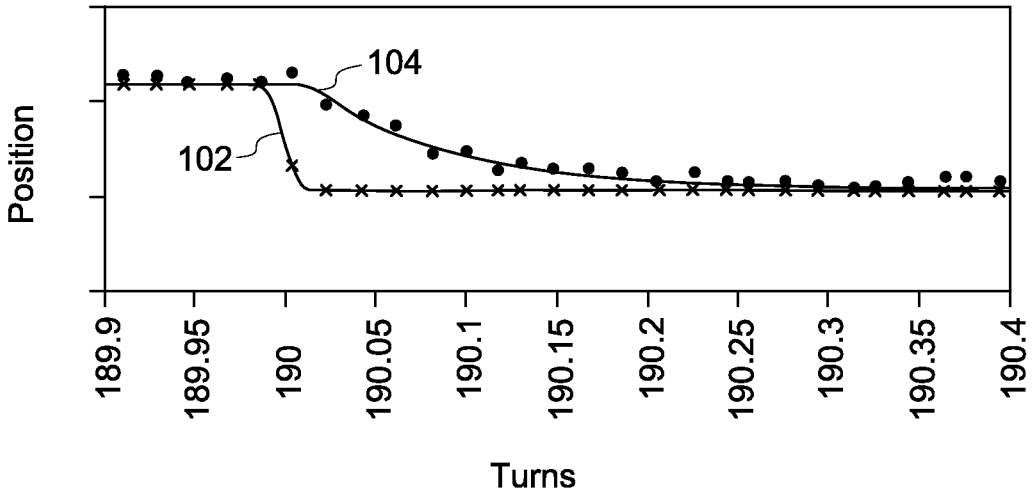
FIGS. 9-10 are illustrations of profile shaping results for transition region reduction applied to test windings.
Figure 10:
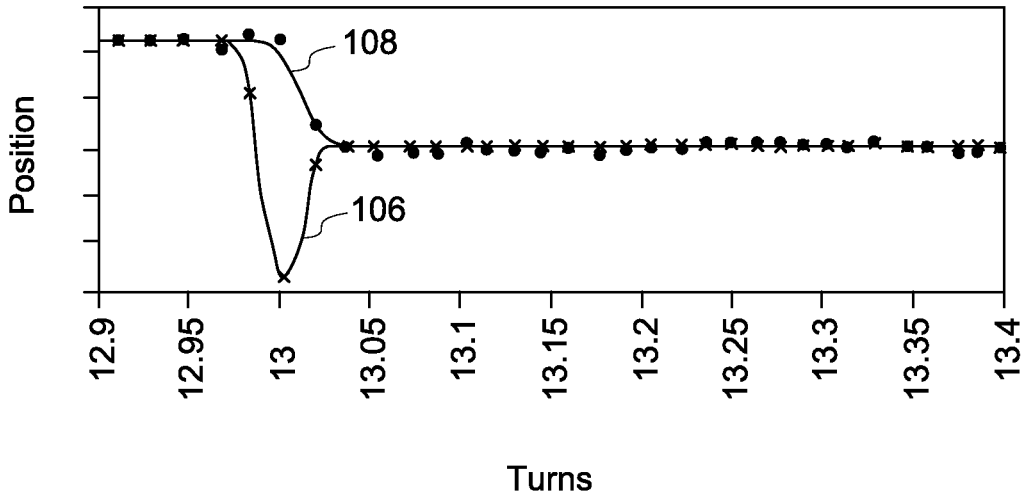

As illustrated in FIGS. 9-10, in one example embodiment, the control algorithms may be used to test windings with and without feed-forward control. In the illustrated embodiment, results of two successive trials for profile shaping for transition region reduction of the wire are shown. Referring to FIG. 9, reference numeral 102 represents a desired transition and measured stage trajectory for the desired transition without profile shaping. Further, reference numeral 104 represents the resulting wire transition response. Turning now to FIG. 10, reference numeral 106 represents the measured stage trajectory for the desired transition with profile shaping. Additionally, reference numeral 108 represents the resulting wire transition response having a smaller transition region. This test illustrates a significant reduction in the interval required to transition from one turn to the next. Further, the test shows that using the modeled winding dynamics to shape the commanded stage motion more effectively achieves the targeted S-shape.

Figure 11A:
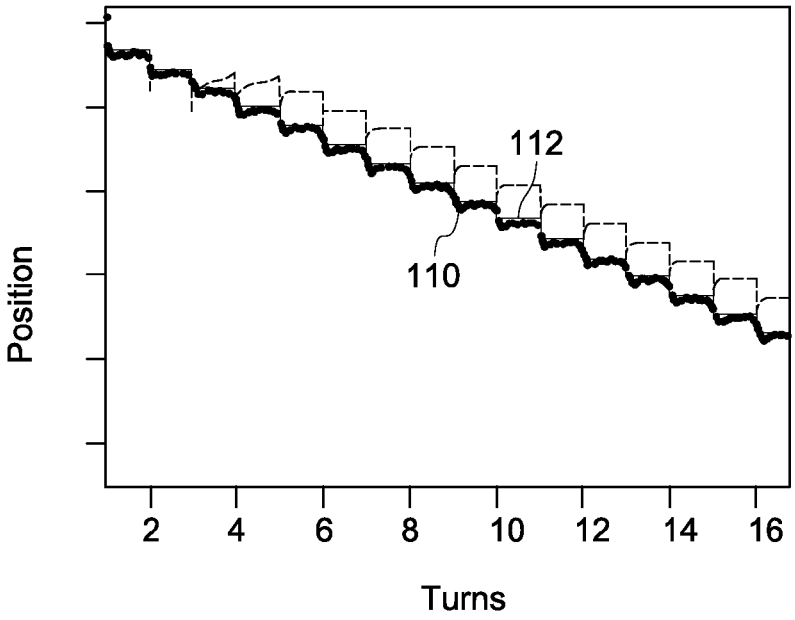
FIGS. 11(*a*)-11(*b*) are graphical representations of desired, actual, and commanded wire positions over the course of winding a single layer under closed-loop control.
Figure 11B:
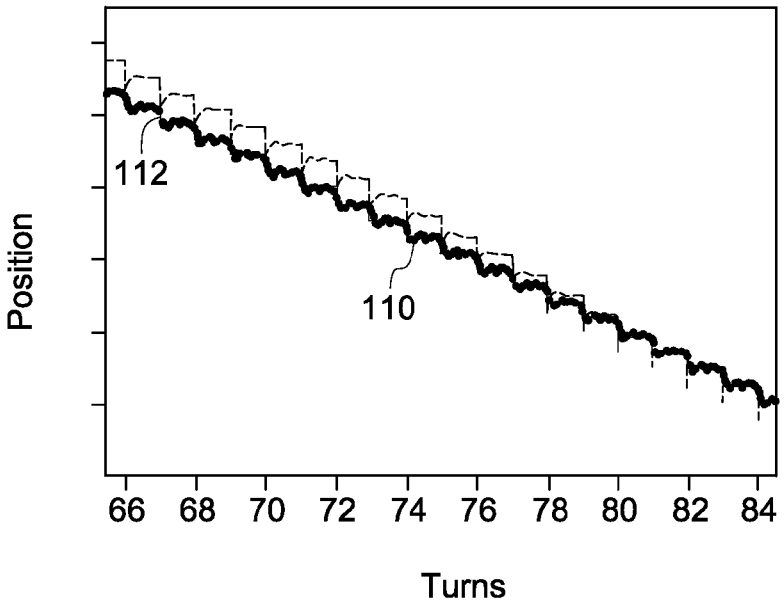

FIGS. 11(*a*) and 11(*b*), illustrate desired and actual wire positions over the course of winding a single layer under closed-loop control. As illustrated in FIG. 11(*a*), at turn number 3, the actual wire position 110 begins to advance ahead of the desired wire position 112, due to a sudden surge of epoxy coating. The small axial position disturbance is detected by the control system, which responds by commanding stage motion in an opposing direction. In one embodiment, the corrective action is limited by design to approximately 2 wire diameters, in order to prevent a "ride-up" event that can occur if the stage backs up excessively over previous windings. This small corrective action proceeds for many turns, yielding incremental improvement on each turn. As illustrated in FIG. 11(*b*), by turn number 80, the wire tracking is again on course, and the actual position 110 matches the desired wire position 112.

In addition to limiting corrective action on each turn to 2 wire diameters, the corrective action is further limited at the two ends of the bobbin to prevent the stage from progressing beyond the flange walls. This is done both to avoid collisions and prevent kinks or bends in the wire.

In certain embodiments, the control algorithm may be configured to provide visual and/or audible alarms to alert the operator to a potential defect condition, and permit timely correction. In these embodiments, the winding is performed automatically, while an operator handles overall speed control and oversight of the process. In some embodiments, even if the measured coil profile shows errors that are within acceptable limits, the system may be configured to deduce at what time in the winding process corrective measures may need to be implemented to prevent further deviation in the coil profile. The alarm may be generated based on the measured coil profile or deduction performed within the system. In embodiments where the system is automatic, the winding, detection of errors, and corrective measures may be performed automatically by the system with minimal or zero intervention from the operator.

In certain embodiments, the control method architecture facilitates production of high-precision, epoxy-impregnated coils. Advantageously, the control methods enable low operating costs, reduced material waste, and reduced labor cost. The control methods increase manufacturing throughput by reducing the number of discarded coils. It should be noted that variations of the control method are envisioned. In one example, different hardware may be used for actuation and sensing. In another example, alternative positioning measures (e.g., side loading), and possibly alternative work-cell arrangements (e.g., coil form stationary and wire supply orbiting the outside) may be used.

Advantageously, automation helps reduce variation in the coil and thus leads to fewer defects and fewer rejected coils. Further, the system may be configured to wind high-precision coils in less time, resulting in lower costs associated with the coils, e.g., material cost, labor cost, processing cost, and the like.

While only certain features of the invention have been illustrated and described herein, many modifications and changes will occur to those skilled in the art. It is, therefore, to be understood that the appended claims are intended to cover all such modifications and changes as fall within the scope of the invention.

The invention claimed is:

1. A method for sensing a position of a lead wire during winding of a wire on a coil form to form a precision coil, the method comprising:

acquiring data representative of at least a portion of the precision coil;

identifying portions of the acquired data that represent the wire in the precision coil; and determining a position of the lead wire at a point of tangency of the lead wire on the coil form from the identified portions of the acquired data, comprising:

displaying a profile of the precision coil;

superimposing on the displayed profile of the precision coil a scale representative of coordinates for the coil form or a reference line marking the desired position of the lead wire, or both; and identifying the position of the lead wire by recognizing a pattern of the lead wire against the superimposed scale or reference line.

2. The method of claim 1, further comprising storing the data representative of the at least portion of the precision coil.

3. The method of claim 2, comprising storing data representative of the position of the lead wire.

4. The method of claim 2, comprising sensing the position of the lead wire using the stored data representative of the at least portion of the precision coil.

5. The method of claim 2, comprising assessing a quality of the precision coil at a later time using the stored data.

6. The method of claim 1, further comprising monitoring a process of winding of the precision coil in real time.

7. The method of claim 1, wherein acquiring the data representative of the at least portion of the precision coil comprises determining a profile of at least a portion of the precision coil.

8. The method of claim 7, comprising storing the data representative of the at least portion of a profile of the precision coil.

9. The method of claim 1, comprising using laser profilometry to acquire data representative of the portion of the precision coil.

10. The method of claim 1, wherein acquiring the data representative of the at least portion of the precision coil comprises using a direct measurement method.

11. The method of claim 1, wherein determining the position of the lead wire comprises determining a longitudinal coordinate, or a radial coordinate, or both the longitudinal coordinate and radial coordinate of the lead wire on the coil form.

12. A method for controlling a position of a lead wire on a coil form during winding of a wire on a coil form to form a precision coil, the method comprising:

acquiring data representative of at least a portion of the precision coil;

identifying portions corresponding to the wire in the precision coil from the acquired data;

determining a position of the lead wire at a point of tangency of the lead wire on the coil form from the identified portions of the acquired data, comprising:

displaying a profile of the precision coil;

superimposing on the displayed profile of the precision coil a scale representative of coordinates for the coil form or a reference line marking the desired position of the lead wire, or both; and identifying the position of the lead wire by recognizing a pattern of the lead wire against the superimposed scale or reference line; and providing feedback control based on a difference between the determined position of the lead wire and a desired position of the lead wire.

13. The method of claim 12, wherein determining the position of the lead wire on the coil form from the identified portions of the acquired data comprises using a direct measurement method.

14. The method of claim 12, wherein determining the position of the lead wire on the coil form comprises using a computer algorithm on a profile of at least a portion of the precision coil.

15. The method of claim 12, wherein providing the feedback control based on the determined position of the lead wire comprises:

comparing the determined position of the lead wire to a desired position of the lead wire; and providing a correction to a position of a wire disposing device to correct the position of the lead wire based on the comparison.

16. The method of claim 15, comprising automatically or manually providing the correction to the position of the wire disposing device.

17. A method for feed-forward action, comprising:

providing a reference trajectory for a wire on a coil form;

determining a feed-forward trajectory for a linear stage; and moving the linear stage according to the feed-forward trajectory such that the feed-forward trajectory enables the wire being disposed on the coil form to follow the reference trajectory.

18. The method of claim 17, wherein the feed-forward trajectory of the linear stage is calculated based on a maximum speed of the linear stage, a maximum acceleration of the linear stage, the reference trajectory of the wire, or combinations thereof.

19. The method of claim 17, wherein the feed-forward trajectory is determined using a kinematic or dynamic model of a winding process.

20. A control method for winding a wire on a surface of a coil form to produce a precision coil, comprising:

generating a feed-forward trajectory, comprising:

determining a transfer function between a position of a linear stage and a resultant position of the lead wire; and calculating a trajectory for the linear stage based on the transfer function and a reference trajectory for the lead wire;

determining a desired lead wire position;

sensing a position of the lead wire; and providing feedback control based on a difference between the desired and sensed wire positions.

21. The method of claim 20, comprising actuating the linear stage using the sensed position of the lead wire.

22. The method of claim 20, wherein the feed-forward trajectory is configured to adjust one or more of a position, a speed, an acceleration, or combinations thereof, of the linear stage to compensate for the winding process kinematic and dynamic responses.

23. The method of claim 20, wherein the feedback control comprises a closed-loop control.

24. The method of claim 23, comprising enabling the closed-loop control in an intermittent fashion.

25. The method of claim 23, wherein the closed-loop control is configured to turn off and revert to open-loop control at cross-over transitions.

26. The method of claim 20, wherein the feedback control is performed manually, automatically, or both manually and automatically.

27. The method of claim 20, wherein the feed-forward trajectory is used to compensate for kinematic and dynamic models of a winding process.

28. The method of claim 20, wherein sensing the position of the lead wire comprises using a matched filter-based process to estimate a position of the lead wire from a profile of at least a portion of the precision coil.

29. The method of claim 20, wherein sensing the position of the lead wire comprises directly measuring the position of the lead wire.

30. The method of claim 20, wherein providing the feed-forward trajectory minimizes a transition region between two consecutive turns of the wire of the precision coil.

31. The method of claim 20, further comprising adjusting the lead wire position on the coil form based on the feedback control.

32. The method of claim 20, wherein the feedback control is configured to reduce variations in the position of the lead wire.

* * * * *